US007303087B2

(12) United States Patent
Flashinski et al.

(10) Patent No.: US 7,303,087 B2
(45) Date of Patent: Dec. 4, 2007

(54) PRESSURIZED PLASTIC BOTTLE WITH REINFORCED NECK AND SHOULDER FOR DISPENSING AN AEROSOL

(75) Inventors: Stanley J. Flashinski, Racine, WI (US); David A. Hoadley, Racine, WI (US); Stephen M. Bednarz, De Kalb, IL (US); Sumit Mukherjee, Sylvania, OH (US)

(73) Assignee: S. C. Johnson & Son, Inc., Racine, WI (US)

( * ) Notice: Subject to any disclaimer, the term of this patent is extended or adjusted under 35 U.S.C. 154(b) by 669 days.

(21) Appl. No.: 10/737,033

(22) Filed: Dec. 16, 2003

(65) Prior Publication Data

US 2005/0127022 A1 Jun. 16, 2005

(51) Int. Cl.
*B65D 1/46* (2006.01)
*B65D 23/00* (2006.01)
*B65D 47/00* (2006.01)

(52) U.S. Cl. ..... 215/42; 215/40; 215/311; 215/324

(58) Field of Classification Search ..... 215/3, 215/4, 40, 42, 324, 311; 220/DIG. 14, 581, 220/582, 592; 222/402.1
See application file for complete search history.

(56) References Cited

U.S. PATENT DOCUMENTS 2,686,081 A 8/1954 Cooksley
2,837,245 A * 6/1958 Grebowiec ..... 222/184
2,876,818 A * 3/1959 Raff et al. ..... 215/12.2
3,934,743 A * 1/1976 McChesney et al. ..... 215/373
4,969,577 A 11/1990 Werding ..... 222/94
5,038,952 A * 8/1991 Dorfman ..... 215/324
5,152,411 A 10/1992 Pope et al. ..... 215/1
5,261,545 A 11/1993 Ota et al.
5,398,826 A 3/1995 Takakusaki et al.
5,829,648 A 11/1998 Goeren et al.
5,853,829 A 12/1998 Krishnakumar et al. ... 428/35.7
6,113,008 A 9/2000 Arsenault et al.
6,338,442 B1 1/2002 De Laforcade
7,028,866 B2 * 4/2006 Kunesh et al. ..... 222/402.1
2002/0148800 A1 * 10/2002 Ozawa et al. ..... 215/40

FOREIGN PATENT DOCUMENTS

JP 59 54525 * 3/1984
WO WO 92/00231 * 1/1992
WO WO 2004/043794 A1 * 5/2004

* cited by examiner

*Primary Examiner*—Sue A. Weaver

(57) ABSTRACT

A pressure resistant plastic bottle for containing and dispensing an aerosol composition. The plastic bottle is designed to reduce deformation by a local reinforcement to the neck and shoulder regions. The reinforcement preferably comprises the provision of a wall thickness for a lower portion of the neck as compared to the wall thickness of the upper portion of the neck to be increased by a ratio of from about 1.25:1 to about 2.5:1.

28 Claims, 3 Drawing Sheets

Effective Modulus vs. Time for PET / PEN at 130°F, 150° F

PRESSURIZED PLASTIC BOTTLE WITH REINFORCED NECK AND SHOULDER FOR DISPENSING AN AEROSOL

BACKGROUND OF THE INVENTION

The present invention relates to dispensers for aerosols or other pressurized products, and more particularly to a pressure resistant plastic bottle containing a reinforced neck and shoulder region for dispensing an aerosol or other comparably pressurized product.

The term "aerosol" will be understood herein to encompass both aerosols, literally, and other liquid or flowable products that can be dispensed from pressurized containers in a manner comparable to aerosolized products. Such products may include but are not limited to foamed or gel preparations or to liquid products delivered in a non-aerosol stream.

Pressurized containers for dispensing aerosols are well known in the art, and are typically constructed of metal in order to withstand the inherent internal pressures of aerosols. However, it is desirable to provide a plastic container capable of withstanding the internal pressures generated by an aerosol because plastic has many advantages over metal. Some of these advantages include the ease and economy of manufacture, and the aesthetic appeal to an end user.

Despite the desirability of using plastic containers for aerosols, there are some inherent disadvantages to utilizing plastic materials in such an environment. For example, it is desirable to avoid plastic containers that have abrupt changes in configuration. The areas of such abrupt changes are stress concentration points which are inherently weak. Another disadvantage is that when the container is subject to internal pressure, certain features of a plastic container may deform. Depending on the wall thickness of the container, the internal volume may change between 3% to 5%. As a result of such stress, slight bulging and/or skewing of a container may occur causing the container to become unsightly, and depending on the location of the deformation, the container could become unstable and may not rest properly on a table or other flat surface. It is thus necessary to provide a container design or shape which, when made of a plastic material, can most effectively resist the internal pressures generated by an aerosol without rupturing or becoming unduly distorted.

A successful plastic bottle design is required to hold internal pressure without fracture or distortion under both room temperature and elevated temperature encountered during shipping and storage (for example, at about 55° C. (131° F.)) for an extended period of time equivalent to the product manufacturing and use cycle (about 6 months). For economic reasons, it is also desirable to design such a plastic bottle from relatively inexpensive plastic material such as stretch blown polyethyleneterephtalate (PET) or polyethyleneterephtalate/polyethylene-naphthalate (PEN) copolymer. Blow molding techniques of such plastic materials are well known in the art, and typically a plastic bottle may be formed by any conventional two-stage blow molding technique. In two-stage blow molding, a preform of a plastic is made by injection molding. The preform provides the mass of material that eventually is blown into the final desired shape. The preform is reheated, enclosed within the halves of a blow mold, and thereafter expanded in such mold. Under such a process, the plastic bottle may be formed integrally in a one-piece construction which is typically the preferred construction. The final bottle usually includes an externally concave neck region which, because of limited material stretching during the blow molding process results in the neck region being virtually "as-injection-molded." When PET is used as the material of construction, the neck region is composed of primarily amorphous PET. The externally convex region below the neck is the shoulder and waist regions which, due to material stretching during the blow molding process, will consist of partially crystalline PET.

Conventional PET or PET/PEN aerosol bottles tend to be unable to hold pressure without distortion at elevated temperatures due to two fundamental weaknesses. First, the neck region is amorphous and will undergo large, irreversible, time-dependent deformations known as "creep." Secondly, the neck region is composed of an externally concave shell configuration which is inherently unstable under internal pressure. The accumulated creep deformation will effectively lower the material stiffness over time until it is at or below the level required to withstand the internal pressure contained by the bottle. When this occurs, the geometric instability of the concave neck region will result in the concave neck region "inverting" to an external convex configuration, i.e. a distorted externally convex configuration that under internal pressure and in the presence of external chemical agents develops micro crazes and voids, which phenomenon is generally known in the industry as "stress crazing." The crazes elongate and propagate with time and finally cause a rupture through the thickness. The shoulder and waist regions, by virtue of the partial crystalinity imparted by the stretch blowing process, will undergo far less creep deformation and will not experience instability since they are inherently stable due to the fact that these regions are externally convex configurations.

As noted above, stress crazing of pressurized plastic containers is commonly observed in stretch blown molded PET containers having regions of high amorphous content with externally concave configurations. The stress crazing will typically occur in the neck region slightly above the shoulder of a molded PET container because this region does not achieve enough orientation during the blow molding process. On the other hand, each of the shoulder, skirt and body regions of stretch blow molded PET containers typically has a high level of molecular orientation caused by the stretching process, and as a result provides better mechanical properties. The stress, designated by the Greek letter sigma, developed in a cylindrical bottle of diameter D and thickness t is given by the equation $\sigma=P(D/2t)$ where P is the internal pressure. Thus, for a container of diameter 5.08 cm (2 inches) with sidewall thickness of 0.0355 cm (0.014 inches) and 9.843 kg/cm$^2$ (140 psi) internal pressure, the stress is approximately 703.1 kg/cm$^2$ (10,000 psi). If this stress is higher than the yield stress of the material, structural deformation and failure may occur. Orientated PET (such as that found in the shoulder, waist and body regions of a bottle) typically has a Youngs modulus of 35,155 kg/cm$^2$ (500,000 psi) and a yield strength of 914.03 kg/cm$^2$ (13,000 psi) at 5% strain. However, for amorphous PET (such as that found in the neck region) the yield strength and Youngs modulus is about ⅛ that of orientated PET, which as noted above, results in poor mechanical properties.

To compensate for lower mechanical properties, one can reduce the container diameter or increase sidewall thickness. Reducing the diameter of the container, however, provides other disadvantages because such a container becomes more difficult to injection and blow mold, and may provide a product container of undesirable dimensions and volume. Likewise, increasing sidewall thickness creates its own unique problems, such as undesirably increasing cycle time and propensity to crystallize the PET due to slow cooling of thicker sidewalls. Thus, a delicate balance of design criteria must be undertaken in order to achieve an aerosol bottle design which can sustain pressure for an extended period of time by reducing the stress levels generated in PET and PET/PEN copolymers at relatively high pressures (at least 8.437 kg/cm$^2$ (120 psi)) and temperatures (at least 50° C. (122° F.)).

SUMMARY OF THE INVENTION

The present invention is directed toward a pressure resistant plastic bottle for containing and dispensing an aerosol composition which includes a reinforcement to its neck region to reduce creep deformation so as to eliminate the previously inherent instability of this region of the plastic bottle. The plastic bottle is comprised of a hollow elongate body having a longitudinal axis and an outer wall. The outer wall defines a neck having an opening therein for receiving and dispensing an aerosol composition. A flange projects radially outwardly from the neck and divides the neck into an upper portion and a lower portion. Local reinforcement of the lower neck portion effectively resists the internal pressures generated by an aerosol to reduce creep deformation and prevent the instability of this region of the bottle.

In order to accomplish reinforcement of the lower neck portion, the wall thickness of the lower neck portion is increased with respect to the wall thickness of the upper neck portion such that it is about 1.25 to about 2.5 times greater than the wall thickness of the upper portion. Preferably, the wall thickness of the lower neck portion is about 1.5 to about 2.25 times greater than the wall thickness of the upper portion, and most preferably the wall thickness of the lower neck portion is about 2 times greater than the wall thickness of the upper neck portion. Thus, a comparison of the wall thickness of the lower portion to the wall thickness of the upper portion ranges between a ratio of from about 1.25:1 to about 2.5:1, preferably as noted above the ratio is from about 1.5:1 to about 2.25:1, and is most preferably about 2:1.

In another aspect of the invention, the local reinforcement can be defined by comparing the wall thickness of the lower neck portion to the radial thickness of the projecting flange. Thus, in order to reduce creep deformation, the reinforcement of the lower neck portion comprises the wall thickness of the lower portion being from about 0.55 to about 1 times the radial thickness of the flange. Preferably, the reinforcement comprises the wall thickness of the lower neck portion being about 0.6 to about 0.8 times the radial thickness of the flange, and most preferably the reinforcement comprises the wall thickness of the lower portion being about 0.7 times the radial thickness of the flange. Thus, the ratio of the wall thickness of the lower neck portion compared to the radial thickness of the flange ranges between a ratio of from about 0.55:1 to about 1:1, preferably from about 0.6:1 to about 0.8:1 and most preferably about 0.7:1. Again, as previously noted, such a design for the lower neck portion and flange provides a neck region which effectively resists the internal pressures generated by an aerosol to minimize any creep deformation effects over time. This design thus provides a neck region which reduces the external concavity thereof and minimizes abrupt changes in the configuration of the neck region to minimize the inherent weakness of the neck region.

DETAILED DESCRIPTION OF THE INVENTION

Figure 1:
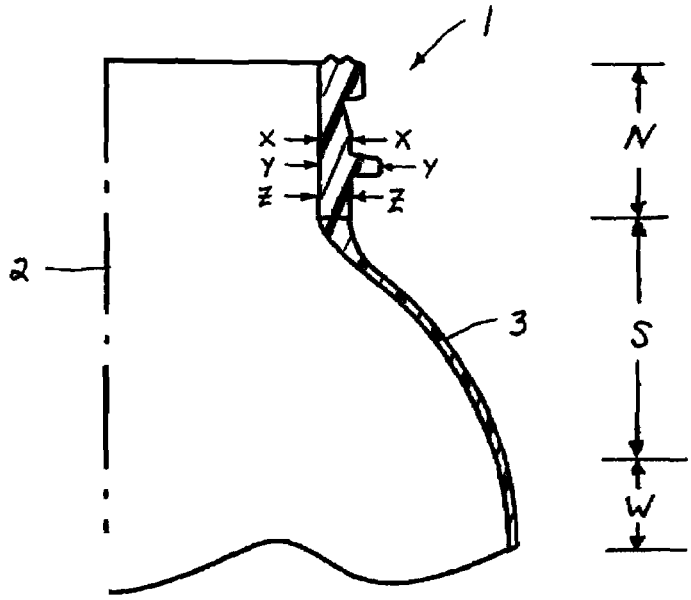
Figure 1 (Prior Art)
FIG. 1 is a fragmentary cross-sectional view of a prior art pressure resistant plastic bottle used for containing and dispensing an aerosol composition.

Referring now to the drawings, there is illustrated in FIG. 1 a prior art pressure resistant plastic bottle generally designated by the numeral 1 for containing and dispensing an aerosol composition. The plastic bottle 1 comprises a hollow elongate body having a longitudinal axis 2 and an outer wall 3. Bottle 1 may be divided into a plurality of regions or portions, namely, a neck portion N, a shoulder portion S, a waist portion W, a generally cylindrical elongate body portion (not shown) and a closed bottom portion (not shown). Each of these portions is integral with the other and is formed as a one-piece construction. Bottle 1 is designed to contain an aerosol composition (not shown) which is typically pressurized at an internal pressure of from about 275.8 kPa (40 psi) to about 620.5 kPa (90 psi). Examples of typical aerosol compositions are insecticides, insect repellants, hair sprays, air fresheners, cleaning preparations, and shave preparations including foams and gels.

As illustrated in FIG. 1, the shoulder portion S and waist portion W define an outwardly projecting convexly-shaped configuration extending along a direction transverse to the axis 2. The term "convexly-shaped" or "convexly-shaped configuration" refers to any curved or rounded shape projecting outwardly with respect to axis 2. Examples of such shapes include a hemisphere, an ellipsoid, a hyperbola, a parabola, an arcuate-shaped configuration, or an arcuate-shaped configuration having multiple arcuate sections such as a combination of a spherical segment having one radius and a spherical end having a second different radius. A convexly-shaped configuration is the preferred configuration for shoulder portion S and waist portion W. In contrast, the transition area between shoulder portion S and neck portion N together with neck portion N provides a substantially inwardly projecting concavely-shaped or concave configuration extending along a direction transverse to axis 2. The term "concavely-shaped" or "concave configuration" refers to any curved or rounded shape projecting inwardly toward longitudinal axis 2. Examples of such shapes include a hemisphere, an ellipsoid, a hyperbola, a parabola, an arcuate-shaped configuration, or an arcuate-shaped configuration having multiple arcuate sections such as a combination of a spherical segment having one radius and a spherical end having a second different radius.

The plastic bottle 1 may be formed by any conventional molding technique, but is preferably formed in a two-stage blow molding process. In two-stage blow molding, a preform of the plastic is made by injection molding. The pre-form provides the mass of material that eventually is blown into final shape. The pre-form is reheated, enclosed within the halves of a blow mold, and thereafter expanded in such mold. Under such a process, the plastic bottle 1 may be formed integrally in a one-piece construction which is the preferred construction. Blow molding techniques, as well as other techniques for manufacturing plastic bottle 1 are well known in the art and need not be further described herein.

When plastic bottle 1 is constructed of conventional stretch blown polyethyleneterephthalate (PET), the neck region N is composed of virtually "as-injection-molded" material, i.e. primarily amorphous PET, because of limited material stretching during the blow molding process. In contrast, the externally convex shoulder region S and waist region W are composed of partially crystalline PET due to material stretching during the blow molding process.

Figure 2:
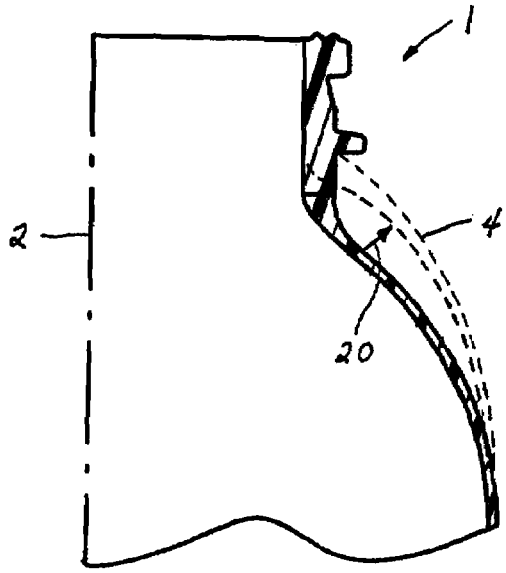
Figure 2 (Prior Art)
FIG. 2 is a cross-sectional view similar to FIG. 1 schematically illustrating the undesirable inversion of the concave neck region to a convex neck region as a result of the internal pressure generated by an aerosol in a prior art plastic bottle.

A successful bottle design is required to hold internal pressure without fracture or distortion under both room temperature and elevated temperature encountered during shipping and storage (for example at about 55° C. (131° F.)) for an extended period of a time equivalent to the product manufacturing and use cycle (about 6 months). Conventional PET aerosol bottles such as the plastic bottle 1 illustrated in FIG. 1 will be unable to hold pressure without distortion at elevated temperature due to two fundamental weaknesses. First, the neck region N is amorphous and will undergo large, irreversible, time dependent creep deformations. Secondly, since the neck region N is effectively a concave configuration, it is inherently unstable under internal pressure. The accumulated creep deformation will effectively lower the material stiffness in the neck region N at some time until it is at or below the level required to withstand the internal pressure contained by the bottle. When this occurs, the concave configuration of the neck region N will invert and result in a convex configuration as illustrated in FIG. 2 by the arrow 20 and by the dashed lines 4. This is an irreversible distortion and results in an unsightly and undesirable bottle. The shoulder region S and waist region W, by virtue of their partial crystallinity imparted by the blow molding process, will undergo far less creep deformation and will not experience instability since these two regions are inherently stable due to their convex configurations.

In order to overcome the above problem, the present invention provides a local reinforcement to the neck region N which reduces creep deformation so that an aerosol bottle design can withstand internal pressure for an extended period of time. Reinforcement of the shoulder region S also functions to further enhance the resistance to internal pressure of the aerosol composition.

Considered independently from the rest of the bottle, the deformation δ of the neck section N under pressure loading is given by:

$$\delta = \frac{P \cdot R^2}{A \cdot E \cdot (1 + V^2)}$$

where P is the bottle pressure, R the mean radius of the neck, A the cross-sectional area (thickness) of the neck and E the effective modulus (elastic modulus modified for the effects of creep).

Figure 3:
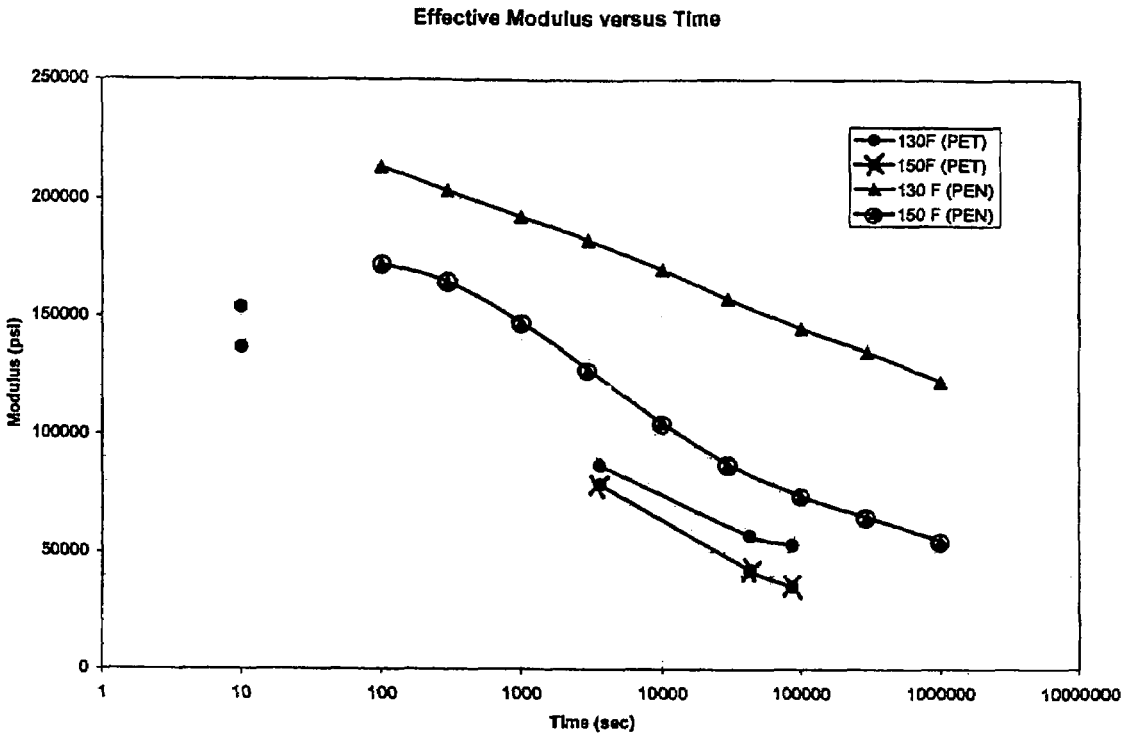
FIG. 3 is a graph illustrating the relationship of Young's modulus versus time for polyethyleneterephtalate (PET) and for polyethylenenaphthalate (PEN) at 54° C. (130° F.) and 66° C. (150° F.)

The effective modulus E is a function of time given approximately by:

$$E(t)=E_o \cdot (t)^{-111}$$

where $E_o$ is the time-zero (instantaneous) Young's modulus of amorphous PET at 54° C. (130° F.) (previously determined to be 12,655.8 kg/cm$^2$ (180,000 psi.)) and t is time under load in seconds. This relationship is shown in FIG. 3 for both PET and PEN at 54° C. (130° F.) and 66° C. (150° F.).

Since pressure and bottle size are typically fixed by design requirements, reducing neck deformation and preventing instability is preferably accomplished by increasing the cross-sectional area A to compensate for the dropping effective modulus with time.

In practice this means that if $A_1$ is in the area of the current design and $A_2$ area of the redesign, then:

$$A_2 = A_1 \cdot \left(\frac{t_2}{t_1}\right)^{0.111}$$

Using the current time to neck instability $t_1$ to be 8 hours and the desired time to instability $t_2$ to be 6 months (4320 hours) gives a cross-sectional area $A_2$ of:

$$A_2 = A_1 \cdot \left(\frac{4320}{8}\right)^{0.111} = 2 \cdot A_1$$

or the cross-sectional area of a redesign should be about twice that of the original design for the desired margin of improvement on time to instability.

By varying the above parameters, it can be seen that the cross-sectional area of the redesign may be about 1.25 to about 2.5 times greater than the original design, preferably about 1.5 to about 2.25 times greater than the original design, and most preferably 2 times greater than the original cross-sectional area.

Figure 4:
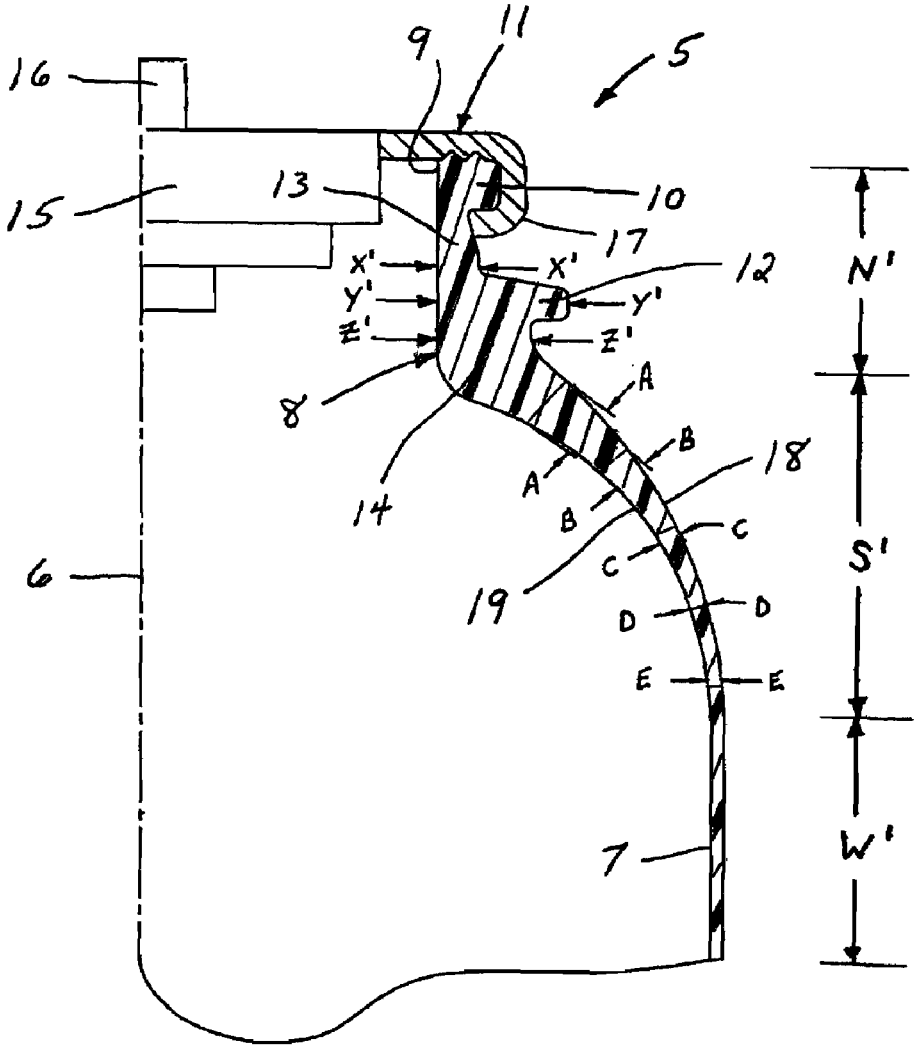
FIG. 4 is a fragmentary cross-sectional view of a pressure resistant plastic bottle used for containing and dispensing an aerosol composition, and having reinforced neck and shoulder regions constructed in accordance with the present invention.

The implemented bottle redesign in accordance with the present invention is illustrated in FIG. 4 along with preferred dimensions relative to the prior art bottle 1 design shown in FIGS. 1 and 2. FIG. 4 illustrates a pressure resistant plastic bottle generally designated by the numeral 5 for containing and dispensing an aerosol composition. The plastic bottle 5 may be composed of any thermoplastic material that may be formed into the desired shape disclosed herein. Examples of such materials include ethylene based polymers, including ethylene/vinyl acetate, ethylene acrylate, ethylene methacrylate, ethylene methyl acrylate, ethylene methyl methacrylate, ethylene vinyl acetate carbon monoxide, and ethylene N-butyl acrylate carbon monoxide, polybutene-1, high and low density polyethylene, polyethylene blends and chemically modified polyethylene, copolymers of ethylene and C1-C6 mono- or di-unsaturated monomers, polyamides, polybutadiene rubber, polyesters such as polyethyleneterephthalate, polyethylene naphthalate, polybutyleneterephthalate; thermoplastic polycarbonates, atactic polyalphaolefins, including atactic polypropylene, polyvinylmethylether and others; thermoplastic polyacrylamides, polyacrylonitrile, copolymers of acrylonitrile and other monomers such as butadiene styrene; polymethyl pentene, polyphenylene sulfide, aromatic polyurethanes; styrene-acrylonitrile, acrylonitrile-butadiene-styrene, styrene-butadiene rubbers, acrylontrile-butadiene-styrene elastomers, polyphenylene sulfide, A-B, A-B-A, A-(B-A)$_n$-B, (A-B)$_n$-Y block polymers wherein the A block comprises a polyvinyl aromatic block such as polystyrene, the B block comprises a rubbery midblock which can be polyisoprene, and optionally hydrogenated, such as polybutadiene, Y comprises a multivalent compound, and n is an integer of at least 3, and mixtures of said substances. The preferred thermoplastic material is polyethyleneterephthalate (PET). PET is commercially available from numerous sources, and one such source is M&G Polymers USA under the trade designation Cleartuf®. Another preferred thermoplastic material is polyethylenenaphthalate (PEN). PEN is commercially available from numerous sources, and one such source is Teijin Chemicals Ltd. under the trade designation TN8065S. Yet another preferred thermoplastic material is a PET/PEN copolymer, preferably one containing 95% PET and 5% PEN. PET/PEN copolymer is commercially available from numerous sources and one such source is M&G Polymers USA under the trade designation Hipertuf® 8010. Finally, another preferred thermoplastic material is polycarbonate. Polycarbonate is commercially available from numerous sources, and one such source is The Dow Chemical Company under the trade designation Calibre® 603. Preferably, the thermoplastic polymer used to make the plastic bottle 1 is transparent, although opaque and partially opaque polymers would also function adequately. The plastic bottle 1 may be formed by any conventional molding technique, but is preferably formed in two-stage blow molding as previously described herein.

Referring again to FIG. 4, the plastic bottle 5 of the present invention comprises a hollow elongate body having a longitudinal axis 6 and an outer wall 7. Like prior art bottle 1, plastic-bottle 5 may be divided into a plurality of sections or portions, namely, neck portion N', shoulder portion S', waist portion W', a body portion (not shown), and a closed bottom portion (not shown), as is conventional. As noted previously, each of these portions are integral with the other and are formed as a one-piece construction to contain the aerosol composition (not shown) which may be of the same type as previously described herein with respect to bottle 1, and which is typically pressurized at the same internal pressures as described with respect to bottle 1.

The convexly-shaped configuration of shoulder portion S' and waist portion W' in combination with the reinforced configuration of neck portion N' functions to enable bottle 5 to contain the pressure of an aerosol therein without any substantial deformation. It should also be noted from FIG. 4 that neck portion N', shoulder portion S' and waist portion W' have smooth surfaces without any abrupt changes which limits stress concentration points and provides maximum resistance to distortion from internal pressures generated by the aerosol within bottle 5. Preferably, all adjoining curves in outer wall 7, especially in neck portion N', shoulder portion S' and waist portion W', and the areas of transition therebetween, are tangent to each other, substantially eliminating stress concentration points.

The outer wall 7 of plastic bottle 5 forms a cylindrical neck 8 having a tubular opening 9 for receiving and dispensing the aerosol composition. Neck 8 includes an annular crimp ring 10 at its uppermost edge adjacent opening 9 which accepts a metal crimp-on closure 11, as will hereinafter be described. A flange 12 projects radially outwardly from neck 8, and divides neck 8 into an upper portion 13 and a lower portion 14. In contrast to the prior art bottle 1 illustrated in FIG. 1 where the upper neck portion has a cross-sectional area or thickness approximately equal to the lower neck portion, it can be seen from FIG. 4 that the lower neck portion 14 of plastic bottle 5 is reinforced with respect to upper portion 13. This reinforcement is illustrated by an increase in cross-sectional area (thickness) of lower portion 14 with respect to upper portion 13. This reinforcement results in the wall thickness of lower portion 14 being about 1.25 to about 2.5 times greater than the wall thickness of upper portion 13. Preferably, the wall thickness of lower portion 14 is about 1.5 to about 2.25 times greater than the wall thickness of upper portion 13, and most preferably the wall thickness of lower portion 14 is about 2 times greater than the wall thickness of upper portion 13. Thus, a comparison of the cross-sectional area or wall thickness of lower portion 14 with respect to upper portion 13 ranges between a ratio of from about 1.25:1 to about 2.5:1, preferably from about 1.5:1 to about 2.25:1, and most preferably about 2:1.

The above ratios are illustrated in FIG. 1 by the preferred dimensions for plastic bottle 5. As illustrated in FIG. 4, upper neck portion 13 has a maximum cross-sectional area $X^1$-$X^1$ of about 0.2 cm (0.079 inches). In comparison, the cross-sectional area $Z^1$-$Z^1$ of the lower neck portion 14 is about 0.4 cm (0.16 inches). Finally, as illustrated, the radial thickness or cross-sectional area $Y^1$-$Y^1$ of flange 12 is about 0.556 cm (0.223 inches). In comparison, the cross-sectional area or thickness X-X of the upper neck portion of the prior art bottle 1 shown in FIG. 1 is the same as the cross-sectional area or thickness Z-Z of the lower neck portion of bottle 1, and is about 0.2 cm (0.079 inches). Also, the cross-sectional area or radial thickness Y-Y of the flange of bottle 1 is about 0.391 cm (0.154 inches). Thus, the ratio of the lower neck portion thickness to the upper neck thickness for bottle 1 is 1:1, and the ratio of the lower neck portion thickness to the radial thickness of the flange is about 0.5:1.

In another aspect of the invention, the reinforcement of lower neck portion 14 can be expressed in terms of a relationship between the wall thickness of lower portion 14 and the radial thickness of flange 12. Thus, the reinforcement of lower portion 14 may be expressed as being from about 0.55 to about 1 times the radial thickness of flange 12, preferably about 0.6 to about 0.8 times the radial thickness of flange 12, and most preferably about 0.7 times the radial thickness of flange 12. These dimensions correspond to a ratio of the wall thickness of lower portion 14 compared to the radial thickness of flange 12 of between about 0.55:1 to about 1:1, preferably from about 0.6:1 to about 0.8:1, and most preferably about 0.7:1. It should be noted that by local reinforcement of lower neck portion 14, the concave configuration of prior art plastic bottle 1 is effectively eliminated in the design of plastic bottle 5.

Closure 11 covers the opening 9 and is sealingly attached to neck 8 to contain the aerosol within the body of plastic bottle 5. Closure 11 includes a valve member 15 having an axially extending valve stem 16 which must be either depressed or tilted to release the aerosol composition contained within bottle 5. Valve member 15 and valve stem 16 are conventional components typically utilized in aerosol containers, and need not be further described herein as they are well known in the art. In order to affix closure 11 onto bottle 5, closure 11 includes a depending annular flange 17 which is inwardly crimped about ring 10 to retain closure 11 on neck 8 of bottle 5.

FIG. 4 also illustrates the thickness profile of shoulder portion S' and waist portion W'. As illustrated, shoulder portion S' integrally depends from neck portion N', and has a circular cross-sectional configuration taken through a plane perpendicular to longitudinal axis 6. Shoulder portion S' and waist portion W' have an outwardly projecting convex configuration extending along its longitudinal direction, and are therefore inherently stable and will undergo far less creep deformation due to their convex configuration. Shoulder portion S' has a convex outer surface 18 and a convex inner surface 19, and as illustrated the surfaces 18, 19 converge toward each other as shoulder portion S' extends downwardly from neck portion N' along its longitudinal direction. This is illustrated by the dimensions A through E in FIG. 5. For the design illustrated, the dimension A is 0.269 cm (0.106 inches), the dimension B is 0.167 cm (0.066 inches), the dimension C is 0.102 cm (0.04 inches), the dimension D is 0.074 cm (0.029 inches) and the dimension E is 0.061 cm (0.024 inches). Thus, this gradually decreasing thickness profile for shoulder portion S' further provides a configuration that effectively resists the internal pressure generated by an aerosol composition.

Other modifications of the plastic bottle 5 of the present invention will become apparent to those skilled in the art from an examination of the above description and drawings. Therefore, other variations of plastic bottle 5 may be made which fall within the scope of the following claims even though such variations were not specifically discussed and/or described above. Thus, plastic bottle 1 may be suitable for any aerosol product such as insecticides, insect repellents, hairsprays, air fresheners, cleaning preparations, and shave preparations including foams and gels, and the like.

We claim:

1. A pressure resistant plastic bottle for containing and dispensing an aerosol composition, comprising:

a hollow elongate body having a longitudinal axis and an outer wall, said outer wall defining a neck having an opening therein for receiving and dispensing an aerosol composition;

a flange projecting radially outwardly from said neck, said flange dividing said neck into an upper portion and a lower portion; and reinforcement means for reinforcing the lower portion of said neck to reduce creep deformation of said lower portion;

wherein the lower portion of said neck and the upper portion of said neck each have a wall thickness, and said reinforcement means comprises the wall thickness of the lower portion being about 1.25 to about 2.5 times greater than the wall thickness of the upper portion.

2. The plastic bottle of claim 1 wherein the lower portion of said neck and the upper portion of said neck each has a wall thickness, and said reinforcement means comprises the wall thickness of the lower portion being about 1.5 to about 2.25 times greater than the wall thickness of the upper portion.

3. The plastic bottle of claim 1 wherein the lower portion of said neck and the upper portion of said neck each has a wall thickness, and the reinforcement means comprises the wall thickness of the lower portion being about 2 times greater than the wall thickness of the upper portion.

4. The plastic bottle of claim 1 wherein the lower portion of said neck has a wall thickness and said flange has a radial thickness, and said reinforcement means comprises the wall thickness of the lower portion being from about 0.55 to about 1 times the radial thickness of the flange.

5. The plastic bottle of claim 1 wherein the lower portion of said neck has a wall thickness and said flange has a radial thickness, and the reinforcement means comprises the wall thickness of the lower portion being about 0.6 to about 0.8 times the radial thickness of the flange.

6. The plastic bottle of claim 1 wherein the lower portion of said neck has a wall thickness and said flange has a radial thickness, and said reinforcement means comprises the wall thickness of the lower portion being about 0.7 times the radial thickness of the flange.

7. A pressure resistant plastic bottle for containing and dispensing an aerosol composition, comprising:

a hollow elongate body having a longitudinal axis and an outer wall, said outer wall defining a neck having an opening therein for receiving and dispensing an aerosol composition;

a flange projecting radially outwardly from said neck, said flange dividing said neck into an upper portion and a lower portion; and wherein the lower portion of said neck has a wall thickness and the upper portion of said neck has a wall thickness such that the wall thickness of the lower portion compared to the wall thickness of the upper portion ranges between a ratio of from about 1.25:1 to about 2.5:1.

8. The plastic bottle of claim 7 wherein said ratio is from about 1.5:1 to about 2.25:1.

9. The plastic bottle of claim 7 wherein said ratio is about 2:1.

10. The plastic bottle of claim 7 wherein said outer wall is composed of a transparent plastic material.

11. The plastic bottle of claim 7 wherein said outer wall is composed of ployethyleneterphtalate.

12. The plastic bottle of claim 7 wherein said outer wall is composed of a polyethyleneterephtalate/polyethylenenaphthalate copolymer.

13. The plastic bottle of claim 7 further including a closure covering said opening and sealingly attached to said neck for containing said aerosol composition within said body.

14. The plastic bottle of claim 13 wherein said closure includes a valve member that enables dispensing of said aerosol composition.

15. The plastic bottle of claim 14 wherein said neck includes an annular rim adjacent said opening and said closure is affixed to said rim.

16. The plastic bottle of claim 7 wherein said body further includes an integral shoulder portion depending from said neck, said shoulder portion having a circular cross-sectional configuration taken through a plane perpendicular to said longitudinal axis and having an outwardly projecting convex configuration extending along its longitudinal direction.

17. The plastic bottle of claim 16 wherein said shoulder portion has an outer surface and an inner surface and wherein the outer and inner surfaces of said shoulder portion converge toward each other as said shoulder portion extends downwardly from said neck along said longitudinal direction.

18. A pressure resistant plastic bottle for containing and dispensing an aerosol composition, comprising:

a hollow elongate body having a longitudinal axis and an outer wall, said outer wall defining a neck having an opening therein for receiving and dispensing an aerosol composition;

a flange projecting radially outwardly from said neck, said flange dividing said neck into an upper portion and a lower portion; and wherein the lower portion of said neck has a wall thickness and said flange has a radial thickness such that the wall thickness of the lower portion compared to the radial thickness of the flange ranges between a ratio of from about 0.55:1 to about 1:1.

19. The plastic bottle of claim 18 wherein said ratio is from about 0.6:1 to about 0.8:1.

20. The plastic bottle of claim 18 wherein said ratio is about 0.7:1.

21. The plastic bottle of claim 18 wherein said outer wall is composed of a transparent plastic material.

22. The plastic bottle of claim 18 wherein said outer wall is composed of polyethyleneterephtalate.

23. The plastic bottle of claim 18 wherein said outer wall is composed of a polyethyleneterephtalate/polyethylenenaphthalate copolymer.

24. The plastic bottle of claim 18 further including a closure covering said opening and sealingly attached to said neck for containing said aerosol composition within said body.

25. The plastic bottle of claim 24 wherein said closure includes a valve member that enables dispensing of said aerosol composition.

26. The plastic bottle of claim 25 wherein said neck includes an annular rim adjacent said opening and said closure is affixed to said rim.

27. The plastic bottle of claim 18 wherein said body further includes an integral shoulder portion depending from said neck, said shoulder portion having a circular cross-sectional configuration taken through a plane perpendicular to said longitudinal axis and having an outwardly projecting convex configuration extending along its longitudinal direction.

28. The plastic bottle of claim 27 wherein said shoulder portion has an outer surface and an inner surface and wherein the outer and inner surfaces of said shoulder portion converge toward each other as said shoulder portion extends downwardly from said neck along said longitudinal direction.

* * * * *